US009556739B2

(12) United States Patent
Springer

(10) Patent No.: US 9,556,739 B2
(45) Date of Patent: Jan. 31, 2017

(54) IMPELLER FOR CENTRIFUGAL PUMPS

(75) Inventor: Peer Springer, Neuhofen (DE)

(73) Assignee: KSB Aktiengesellschaft, Frankenthal (DE)

( * ) Notice: Subject to any disclaimer, the term of this patent is extended or adjusted under 35 U.S.C. 154(b) by 482 days.

(21) Appl. No.: 14/007,415

(22) PCT Filed: Apr. 18, 2012

(86) PCT No.: PCT/EP2012/057035

§ 371 (c)(1),
(2), (4) Date: Nov. 14, 2013

(87) PCT Pub. No.: WO2012/143367

PCT Pub. Date: Oct. 26, 2012

(65) Prior Publication Data

US 2014/0064970 A1 Mar. 6, 2014

(30) Foreign Application Priority Data

Apr. 21, 2011 (DE) ..... 10 2011 007 907

(51) Int. Cl.
*F01D 5/14* (2006.01)
*F04D 29/22* (2006.01)
*F04D 29/24* (2006.01)

(52) U.S. Cl.
CPC ..... *F01D 5/141* (2013.01); *F04D 29/2294* (2013.01); *F04D 29/242* (2013.01)

(58) Field of Classification Search
CPC ..... F04D 29/2294; F04D 29/242; F01D 5/141
See application file for complete search history.

(56) References Cited

U.S. PATENT DOCUMENTS 1,182,439 A * 5/1916 Wood ..... F04D 29/30 415/203
1,864,834 A * 6/1932 Klosson ..... F04D 29/225 415/203
2,236,706 A * 4/1941 Damonte ..... F04D 7/04 415/196
2,272,469 A * 2/1942 Lannert ..... F04D 29/225 415/204
2,396,083 A * 3/1946 Chase ..... F04D 29/445 415/112

(Continued)

FOREIGN PATENT DOCUMENTS

DE 40 15 331 A1 11/1991
DE 88 00 074 U1 2/1998

OTHER PUBLICATIONS

International Search Report dated Nov. 21, 2012 w/ English translation (four (4) pages).

(Continued)

*Primary Examiner* — Igor Kershteyn
(74) *Attorney, Agent, or Firm* — Crowell & Moring LLP

(57) ABSTRACT

An impeller of a centrifugal pump is provided. The impeller includes at least two blades (4) for conveying media containing solids. An impeller blade leading angle ($\beta_1$) is smaller than 0°. The blade angle ($\beta$) increases in a first section (9) until a value of 0° is reached. In a second section (10), another increase occurs until a maximum value is reached. In a third section (11), the blade angle ($\beta$) decreases again.

11 Claims, 4 Drawing Sheets

(56) References Cited

U.S. PATENT DOCUMENTS

Figure 1:
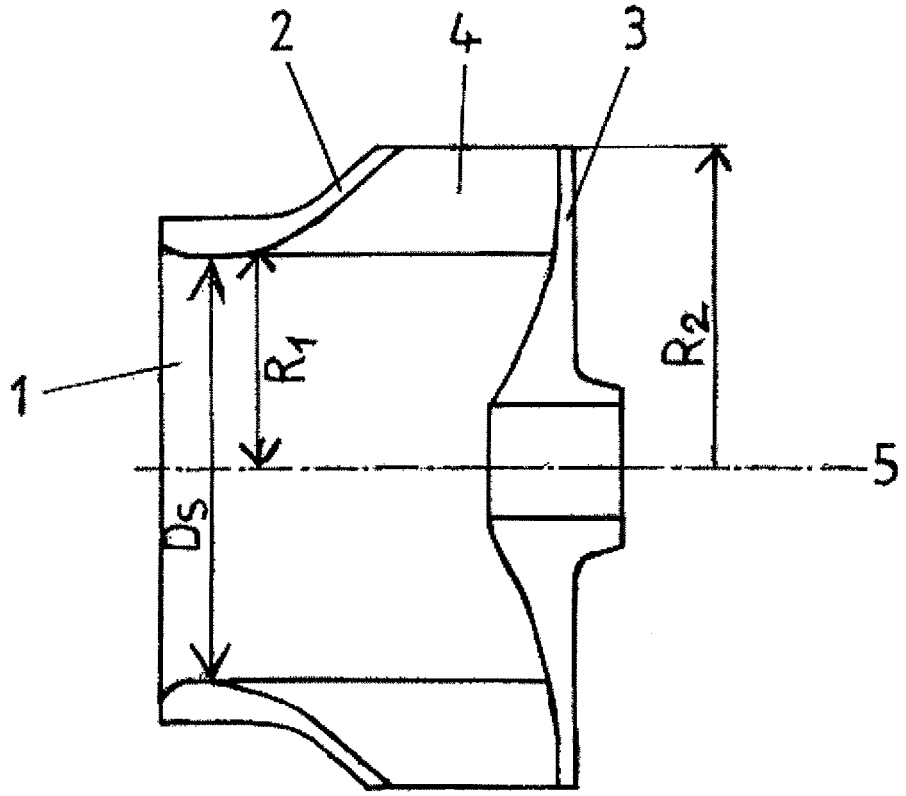

| | | | | | |
|---|---|---|---|---|---|
| 4,087,994 | A * | 5/1978 | Goodlaxson | F04D 29/2277 | 415/143 |
| 4,681,508 | A * | 7/1987 | Kim | F04D 29/2238 | 415/116 |
| 5,348,444 | A | 9/1994 | Metzinger et al. | | |
| 5,692,880 | A * | 12/1997 | Zelder | F04D 29/225 | 416/175 |
| 6,725,797 | B2 * | 4/2004 | Hilleman | B63G 13/02 | 114/151 |
| 8,025,479 | B2 * | 9/2011 | Scott | F04D 7/04 | 415/206 |

OTHER PUBLICATIONS

International Preliminary Report on Patentability (PCT/IB/373) dated Oct. 22, 2013, including English Translation of Written Opinion (PCT/ISA/237) (five (5) pages).

* cited by examiner

β[°]
βmax

β
0
β1<0

R
β1
R2
β2
R1
φ[°]
9
10
11
12

IMPELLER FOR CENTRIFUGAL PUMPS

The invention relates to an impeller for centrifugal pumps having at least two blades for conveying solids-containing media.

DE 40 15 331 A1 describes an impeller having only one blade. The single-blade wheel which is produced by a casting process forms a channel between a front cover shroud and a rear cover shroud and a blade, the cross section of which channel decreases from the inlet of the single-blade wheel toward the outlet. On the first 180° of the rotary angle, the suction side forms a semicircle which is arranged concentrically with respect to the rotational axis. The single-blade impeller is designed in such a way that early bubble formation and therefore the occurrence of cavitation are prevented. The blade tip has a very large curvature radius. This flattened portion prevents the accumulation of long-fibered constituent parts.

In contrast to single-blade wheels, impellers having a plurality of blades are distinguished by a high degree of efficiency. However, particular requirements are also made of impellers of this type with regard to the prevention of the accumulation of solid constituent parts in the conveying path. In multiple-blade impellers, special measures have to be implemented to avoid clogging.

The suitability of said impellers for the wastewater field is tested, inter alia, by the ball passage. The ball passage describes the capability of the impellers to also convey large solid bodies which correspond to a ball.

DE 88 00 074 U1 describes a pump impeller for a centrifugal pump, the blade entry angle of which pump impeller is between 0° and 40°. Here, the impeller blades are designed in such a way that the occurrence of cavitation is reduced and nevertheless a satisfactory suction capability is ensured in the overload range. To this end, the flow lines of the impeller blades have a section, in which the blade angle increases by up to 25°.

In wastewater technology, centrifugal pumps with high specific rotational speeds are being used more and more frequently. In conventional impellers, this leads to the stagnation point of a blade approaching flow migrating to the pressure side of the blades, in particular in part load operation. The entry edges of the blades are flowed around from the pressure side to the suction side. The stagnation point which lies on the pressure side presses fibers which are situated in the wastewater firmly onto the surface of the blades.

There is a high speed region in the circumfluence of the entry edges of the blades. In impellers, the entry edge of which has a small curvature radius, the speeds are particularly high in said region. If the static pressure falls below the vapor pressure on account of the high flow speed, vapor bubbles are formed which lead to cavitation damage.

The high speed region is adjoined by a lower speed region. Eddy water is formed there. Fibers which adhere to the entry edge tend to fill said eddy water. The fibers are pressed onto the blade contour by the circumfluence, it being possible for the coverage with fibers to rise greatly.

It is an object of the present invention to provide an impeller with a high degree of efficiency, in which deposits and the occurrence of cavitation are avoided.

According to the invention, this object is achieved by virtue of the fact that the blade entry angle is smaller than 0°, the blade angle increasing in a first section until it reaches a value of 0°, then increasing in a second section up to a maximum value and decreasing in a third section.

According to the invention, the blade angle at the inlet is smaller than 0° and then increases. This leads to a pronounced curvature of the blade contour. The angular profile ensures uniform loading of the entire blade face. The stagnation point of the flow is displaced from the pressure side into the region of maximum curvature of the entry edge or even onto the suction side. As a result, the loading of the blade entry edge and the forces which press on fibers in the entry region are reduced. A region of high speeds is formed on the suction side of the blades, which region contributes to detaching of adhering fibers. After a maximum value is reached, the blade angle decreases again. The blade profile exhibits an S-shape.

The aim of the design consists in reducing the loading of the blade approaching flow edge and the pressure-side stagnation pressure region.

In a hydraulically shock-free blade approaching flow, the (approaching flow) speed at the blade profile nose point is approximately zero. The circumfluence around the blade profile is homogeneous.

In contrast, an oblique blade approaching flow results in part load operation, the stagnation point migrating from the blade profile nose point to the pressure-side blade side. The part load approaching flow is then at an angle with respect to the blade camber line. Extremely high speeds then occur during the circumfluence of the profile nose and primarily at the point of greatest curvature, the nose point. A retardation of the flow speed is produced on the blade suction side, as a result of which the consequence is the formation of a separation region on the suction side downstream of the blade profile nose point in the flow direction. As a result, the flow no longer bears against the blade, is detached from the blades and reduces the cross section, delimited by adjoining blades, of a throughflow channel in the impeller. Fibers can be sucked into the separation region which lies downstream of the nose point.

In contrast, the profile according to the invention of the blade profile and therefore of the blade angle achieves a further flow acceleration in the part load range even during part load operation, as a result of which the separation region is kept small. The point of highest flow speed is therefore moved into the middle part of the blade suction side. The result of this solution is that fibers or the like which are entrained by a flow are no longer pressed onto the blade approaching flow edge. Instead, they are transported away by the high speeds in the middle, suction-side blade part. Clogging of the impeller inlet is therefore prevented.

In one preferred embodiment of the invention, the blade angle remains constant in an adjoining fourth section. The impeller has a constantly small blade angle in the radial region of the pump. The extension of the back flow region on the pressure side is reduced by the loading of the suction side. The small blade exit angle reduces the loading at the blade end and reduces the laminar back flow region on the blade pressure side.

In one preferred embodiment of the invention which is suitable, in particular, for high specific rotational speeds, the blade angle is smaller than −10° in the entry region. The small entry angles lead to a hydraulically shock-free approaching flow.

In the first section, the blade angle increases until it reaches a value of 0°. A further increase in the blade angle then takes place in a second section until a maximum value is reached. The blade angle preferably increases in the first and second sections with the same gradient.

In one advantageous embodiment of the invention, the blade angle increases with a gradient of more than 0.35 in the first and/or second section. The pronounced curvature leads to homogeneous blade loading in the middle blade face region. The loading distribution is maintained even in the case of part load as a result of the extreme angular increase in the front part of the blade. The increased loading of the entry edge which normally reinforces the adhesion effect is reduced as a result.

It proves particularly favorable if, from a reversal point, the blade angle decreases in a third section to the blade exit angle. The blade angle preferably remains constant in a fourth section.

It proves particularly favorable if the impeller is configured as a radial wheel. Here, the ratio of blade exit radius to blade entry radius is preferably smaller than 1.5. As a result, the impeller can be operated effectively even at high specific rotational speeds.

In conventional impellers, great curvature radii of the blade entry edges are required, in order to avoid high circumfluence speeds and the associated occurrence of cavitation. This necessitates accumulations of material which lead to heavy impellers. On account of the blade angular profile according to the invention, it is possible to use impellers which have a small curvature radius of the blade entry edges. The curvature radius of the blade entry edges is preferably equal to or smaller than the value of the blade thickness in the fourth region. Despite the high circumfluence speeds which occur here, cavitation damage does not occur in the case of the impellers according to the invention. On account of the small curvature radius of the blade entry edges, the impellers can be of slim and lightweight configuration.

The impeller which is used to convey wastewater preferably comprises two or three blades. Embodiments of this type are particularly suitable for wastewaters having a high proportion of solid constituents, and are also called a two-channel wheel or three-channel wheel. There is the risk of clogging if the number of blades is too great. In comparison with single-blade wheels, the two-blade or three-blade impellers ensure a higher degree of efficiency and improved operating behavior on account of the lack of unbalance and lower-pulsation conveying.

The impeller preferably has a cover shroud and is therefore configured with a closed overall design.

Figure 2A:
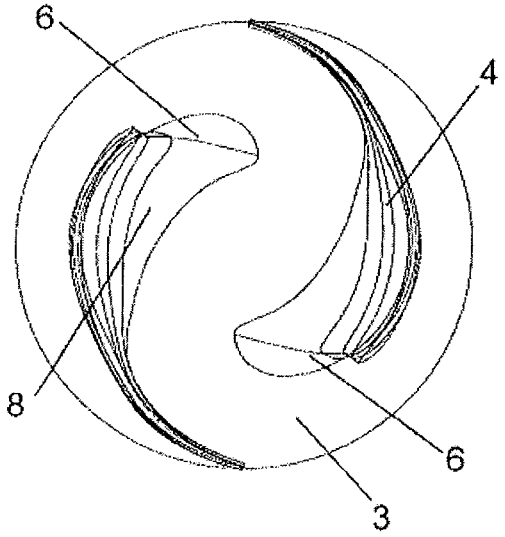
Figure 2B:
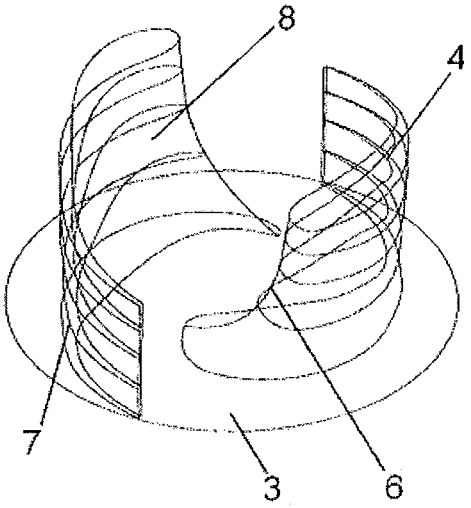
Figures 3A, 3B:
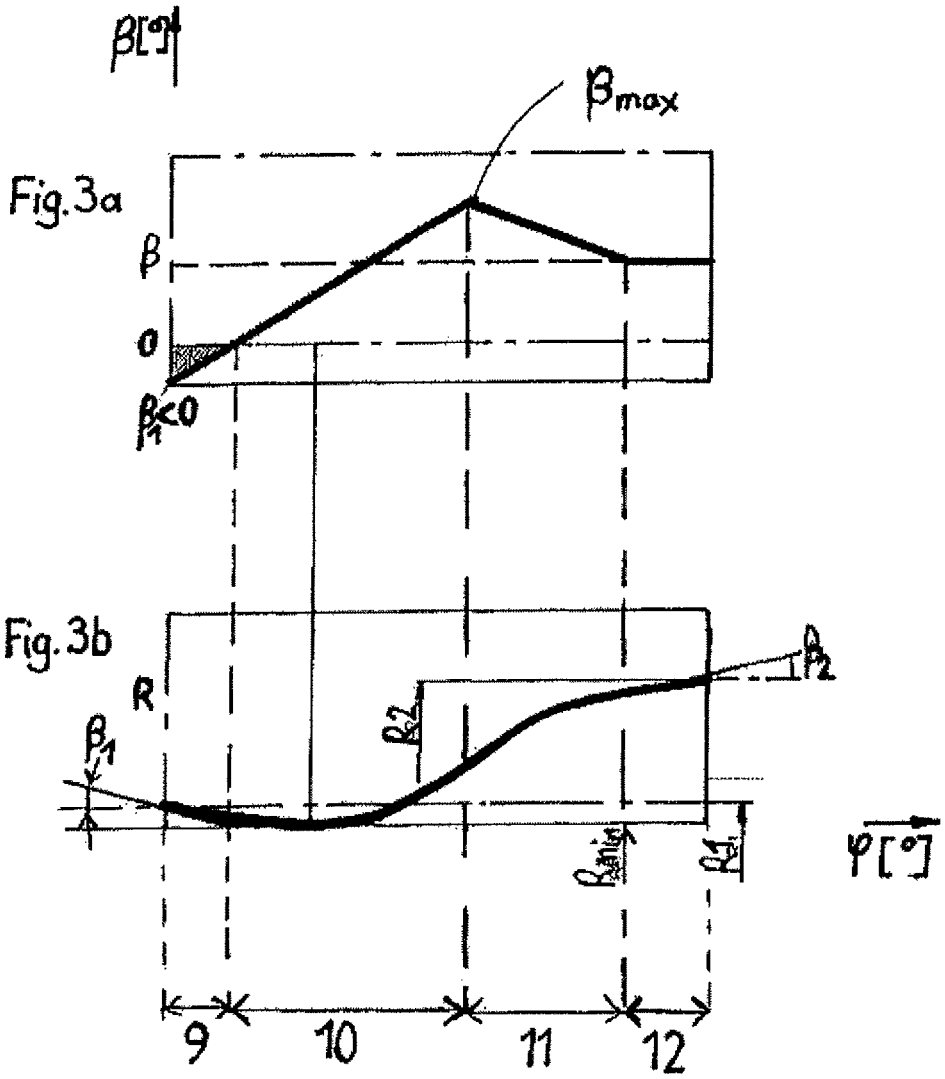
Figures 4A, 4B:
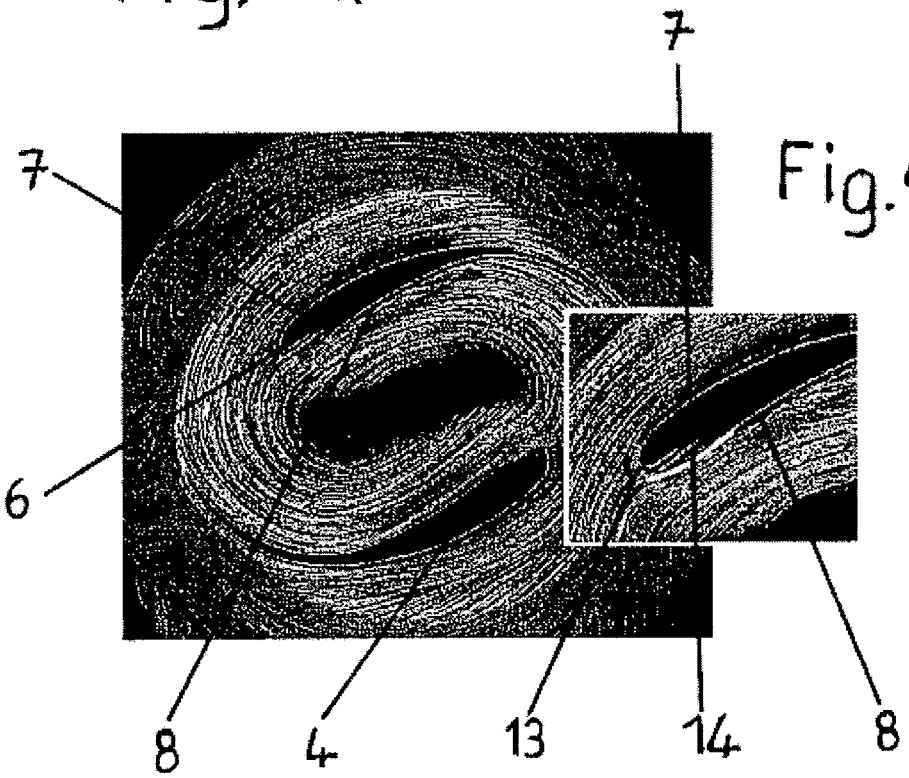

Further features and advantages of the invention result from the description of exemplary embodiments using drawings, and from the drawings themselves, in which:

FIG. 1 shows an axial section through an impeller,

FIG. 2*a* shows a front view of the blades of the impeller,

FIG. 2*b* shows a perspective view of the blades of the impeller,

FIG. 3*a* shows a profile of the blade angle,

FIG. 3*b* shows an accordant diagram of the camber line,

FIG. 4*a* shows a radial section through the impeller with an illustration of the speeds of the flow lines, and FIG. 4*b* shows an enlarged illustration of the entry part of a blade according to FIG. 4*a*.

FIG. 1 shows an axial section through a radial impeller. The liquid which is interspersed with solid constituents enters the impeller through the suction port 1. The blades 4 which are arranged between the cover shroud 2 and the rear shroud 3 accelerate the liquid. The liquid flows from the rotational axis 5 radially to the outside. The impeller is operated at specific rotational speeds of more than 70. Here, a low ratio of blade exit radius $R_2$ to blade entry radius $R_1$ proves particularly favorable. In the exemplary embodiment, the ratio of blade exit radius $R_2$ to blade entry radius $R_1$ is smaller than 1.3.

FIGS. 2*a* and 2*b* show a front view and a perspective illustration of the blades 4 of the impeller. The impeller comprises two blades 4 which are fastened on a rear shroud 3. The impeller rotates in the clockwise direction in the view of the illustrations. The blade entry edges 6 have a small curvature radius. In the exemplary embodiment, the curvature radius is 7 mm. The solids-containing medium is accelerated by the blades 4. A distinction is made between the pressure side 7 and the suction side 8 of the blades 4.

FIG. 3*a* shows the profile of the blade angle β. FIG. 3*b* shows an accordant illustration of the camber line. The angle of deflection φ is plotted on the abscissa. The blade angle β of the camber line is plotted on the ordinate. The blade entry angle $\beta_1$ is smaller than 0°. In a first section 9, the blade angle β increases continuously until it reaches a value of 0°. A further continuous increase then takes place in a second section 10 until the blade angle β reaches a maximum value. The gradients of the increase of the blade angle β in the first section 9 and the second section 10 are identical. The blade angle β reaches its maximum value at the reversal point of the camber line. In a third section 11, the blade angle β decreases continuously until it reaches the value of the blade exit angle $\beta_2$. In a fourth section 12, the blade angle β remains constant at the value of the blade exit angle $\beta_2$.

The accordant diagram of the camber line shows that, starting from the blade entry radius $R_1$, the radius first of all decreases to a minimum value $R_{min}$ and subsequently increases again as far as the value of the blade exit radius $R_2$.

FIGS. 4*a* and 4*b* show a radial section of a two-blade impeller with an illustration of the flow lines which have different speeds. The impeller rotates counter to the clockwise direction in the view of the figures. In contrast to conventional impellers, the stagnation point 13 of the flow does not lie on the pressure side 7, but rather in the region of maximum curvature of the blade entry edge 6. A region 14 of high speeds which contributes to detaching of adhering fibers is formed on the suction side 8 of the blades 4.

In the impeller according to the invention, the loading of the blade entry edge 6 is reduced. As a result, the forces decrease which press fibers on in the entry region. As a result of the loading of the middle suction-side region of the blade 4, high speeds occur there, as a result of which adhering fibers are transported away.

The invention claimed is:

1. An impeller for centrifugal pumps having at least two blades for conveying solids-containing media, characterized in that that a blade angle (β) at an entry point of each blade is smaller than 0°, the blade angle increasing in a first section from the entry point until it reaches a value of 0°, then increasing in a second section up to a maximum value and then decreasing in a third section.

2. The impeller as claimed in claim 1, characterized in that the blade angle at the entry point is smaller than −10°.

3. The impeller as claimed in claim 1, characterized in that the blade angle increases with the same gradient in the first section and second section.

4. The impeller as claimed in claim 1, characterized in that the blade angle increases with a gradient of more than 0.35 in the first section and/or second section.

5. The impeller as claimed in claim 1, characterized in that, from a reversal point between the second section and the third section, the blade angle decreases in the third section to a blade exit angle.

6. The impeller as claimed in claim 5, characterized in that the blade angle remains constant in a fourth section after the third section.

7. The impeller as claimed in claim 1, characterized in that the impeller is configured as a radial wheel.

8. The impeller as claimed in claim 1, characterized in that a ratio of blade exit radius to blade entry radius is smaller than 1.5.

9. The impeller as claimed in claim 1, characterized in that a curvature radius of blade entry edges is equal to or smaller than a value of a blade thickness in the fourth section.

10. The impeller as claimed in claim 1, characterized in that the impeller has at most three blades.

11. The impeller as claimed in claim 1, characterized in that the impeller has a cover shroud.

* * * * *